United States Patent [19]

Nerheim

[11] Patent Number: 4,840,122

[45] Date of Patent: Jun. 20, 1989

[54] INTEGRATED SILICON PLASMA SWITCH

[75] Inventor: Eldon Nerheim, Edina, Minn.

[73] Assignee: Honeywell Inc., Minneapolis, Minn.

[21] Appl. No.: 182,378

[22] Filed: Apr. 18, 1988

[51] Int. Cl.[4] ..... F42C 19/12; F42B 3/12

[52] U.S. Cl. ..... 102/202.5; 102/202.7

[58] Field of Search ..... 102/202.5, 202.7, 202.9, 102/202.14, 206, 218, 219

[56] References Cited

U.S. PATENT DOCUMENTS

| | | | |
|---|---|---|---|
| 3,009,077 | 11/1961 | Jacob | 102/219 |
| 3,249,800 | 5/1966 | Huber | 102/202.5 |
| 3,269,315 | 8/1966 | Gauld | 102/202.5 |
| 3,288,068 | 11/1966 | Jefferson et al. | 102/206 |
| 3,366,055 | 1/1968 | Hollander, Jr. | 102/202.5 |
| 3,611,023 | 10/1971 | Souza, Jr. | 315/208 |
| 3,882,323 | 5/1975 | Smolker | 102/202.5 |
| 3,882,324 | 5/1975 | Smolker et al. | 102/202.5 |
| 4,085,397 | 4/1978 | Yagher, Jr. | 337/407 |
| 4,471,697 | 9/1984 | McCormick et al. | 102/202.14 |
| 4,559,875 | 12/1985 | Marshall | 102/218 |
| 4,575,692 | 3/1986 | Goldie | 333/13 |
| 4,602,565 | 7/1986 | MacDonald et al. | 102/202.7 |
| 4,631,453 | 12/1986 | deSouza et al. | 315/340 |
| 4,708,060 | 11/1987 | Bickes, Jr. et al. | 102/202.5 |
| 4,729,315 | 3/1988 | Proffit et al. | 102/202.5 |
| 4,788,913 | 12/1988 | Stroud et al. | 102/202.5 |

*Primary Examiner*—Charles T. Jordan

*Attorney, Agent, or Firm*—Orrin M. Haugen; Thomas J. Nikolai; Frederick W. Niebuhr

[57] ABSTRACT

A switch device for one-time use in conducting very high currents comprising a silicon substrate on which is deposited a amorphous silicon or polysilicon strip extending as a bridge between first and second spaced-apart metal contacts deposited on the silicon substrate. Also deposited on the same substrate on opposite sides of the bridge and spaced from it are a set of high voltage contacts. When a high voltage is applied across the contacts, no current flows until a trigger current is made to flow through the bridge, the trigger current being sufficiently large to vaporize the bridge creating a plasma cloud. The plasma, being highly conductive, allows a very large current to flow between the high voltage contacts. The device of the present invention finds special application as part of a detonation system for high explosive ammunitions. This specification discloses various modifications to the above structure to achieve desired performance characteristics.

12 Claims, 3 Drawing Sheets

INTEGRATED SILICON PLASMA SWITCH

BACKGROUND OF THE INVENTION

I. Field of the Invention:

This invention relates generally to a fast-acting switch for conducting large amounts of electrical energy, and more particularly an integrated circuit switching device which, when triggered by a relatively low energy signal, produces a plasma cloud providing a very low impedance discharge path between two high voltage terminals forming a part of the integrated circuit structure.

II. Discussion of the Prior Art:

As is set forth in the Marshall U.S. Pat. No. 4,559,875 entitled "High Energy Switching Circuit for Initiator Means or the Like and Method Therefor", a need exists in the munitions field for a device which will operate reliably to switch very large currents upon triggering thereof. Typically such a device can be used to control the energization of a sapper detonator or to set off a primer charge or a train of a primary charge and one or more booster charges. Given the particular application, it is imperative that such a detonator device have the ability to survive and operate in high G environments. For example, in certain weaponry, it is intended that an explosive shell penetrate through the walls of the fortification before the explosion is detonated. As such, it is essential that the detonation device for the projectile be able to survive the forces encountered during firing, impact and penetration while still reliably detonating the primary explosive charge when triggered or detonated.

In the Hollander U.S. Pat. No. 3,366,055, there is disclosed a semiconductor explosive igniter constructed such that when an electrical current is applied to it, the resistivity of the semiconductor material increases due to heating to a critical point where its resistivity drops precipitously and the semiconductor device disintegrates to release a shock wave sufficient to detonate certain types of high explosives. In accordance with the invention of the Hollander Patent, the critical temperature at which the resistivity drops can be controlled during the manufacture of the semiconductor device by appropriate doping of the silicon material.

SUMMARY OF THE INVENTION

The present invention is similar to the device of the Hollander patent to the extent that it utilizes semiconductor integrated circuit techniques in its manufacture. However, it differs from that device, as well as from other known prior art devices, in its specific geometry and mode of operation. The integrated silicon plasma switch of the present invention comprises a silicon substrate on which is formed, by suitable masking and etching techniques, a first pair of spaced-apart, conductive wire bond pads joined by a thin ribbon of amorphous silicon or polysilicon material. Also formed on the same substrate on opposite sides of the ribbon bridge is an additional pair of conductive wire-bond pads, the opposed end portions of which come within a predetermined spaced distance from the bridge which passes therebetween. The above-described chip may then be appropriately packaged within a ceramic or plastic housing using well-known integrated circuit construction techniques.

Ultrasonic wire-bonding techniques may be used to join the two pairs of wire-bond pads on the chip to the lead frame of the ceramic package.

In use, a high voltage, e.g., 2000 volts, is applied across the spaced-apart wire bond pads on either side of the polysilicon bridge. The spacing and the dielectric properties of the silicon substrate materials are such as to preclude voltage breakdown therebetween. Now, when a trigger current of a predetermined amplitude is made to flow through the polysilicon bridge material, it heats to the point where it vaporizes, creating a plasma cloud within the housing or case. Formation of the plasma cloud thus creates a low impedance (1 ohm or less) discharge path between the two high voltage terminals, allowing a substantial current to flow through that circuit path.

By proper attention to the device geometry, a low input trigger energy may be used to control high voltage/high current switching action. Because of the very low mass of the detonator device, it is able to survive and operate in very high G environments.

To avoid a loss of heat due to conduction through the silicon substrate which would detract from the ability of the silicon bridge to vaporize, it is further contemplated that the silicon substrate be back-etched beneath the bridge to remove or reduce the thermal mass to which the silicon bridge strip is exposed.

In accordance with still a further aspect of the invention, it is contemplated that a load device, e.g., a slapper detonator bridge, be formed on the same silicon die or substrate as the plasma switch. Alternatively, the integrated plasma switch may be mounted on a suitable printed circuit substrate with printed circuit connections being made between the integrated plasma switch module, the high voltage source and the silicon slapper detonator bridge.

OBJECTS

It is accordingly a principal object of the present invention to provide an improved, fast-acting, high-voltage/high-current switch using integrated circuit techniques.

Another object of the invention is to provide a high voltage/high current switch which is very small in size and extremely rugged due to its solid state design.

Yet another object of the invention is to provide a semiconductor switching device which depends upon the creation of a low impedance plasma cloud for discharging a high voltage/high current source through a load device.

Yet a further object of the invention is to provide a triggerable semiconductor switching device in which an amorphous silicon or polysilicon material is heated by triggering energy to the point where the bridge vaporizes to create a plasma cloud.

A related object of the invention is to provide an integrated circuit switching device in which a polysilicon bridge is formed on a silicon die and appropriate metal contacts are provided for coupling the triggering energy to the polysilicon bridge and for coupling the high voltage source/load circuit to the device.

Still another object of the invention is to provide an integrated circuit plasma switch in which the substrate on which the integrated circuit is formed is treated to reduce parasitic thermal conduction losses.

A yet further object of the invention contemplates the integration of a plasma silicon switch on the same silicon die with an integrated silicon slapper detonator bridge.

Still other objects and advantages and features of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
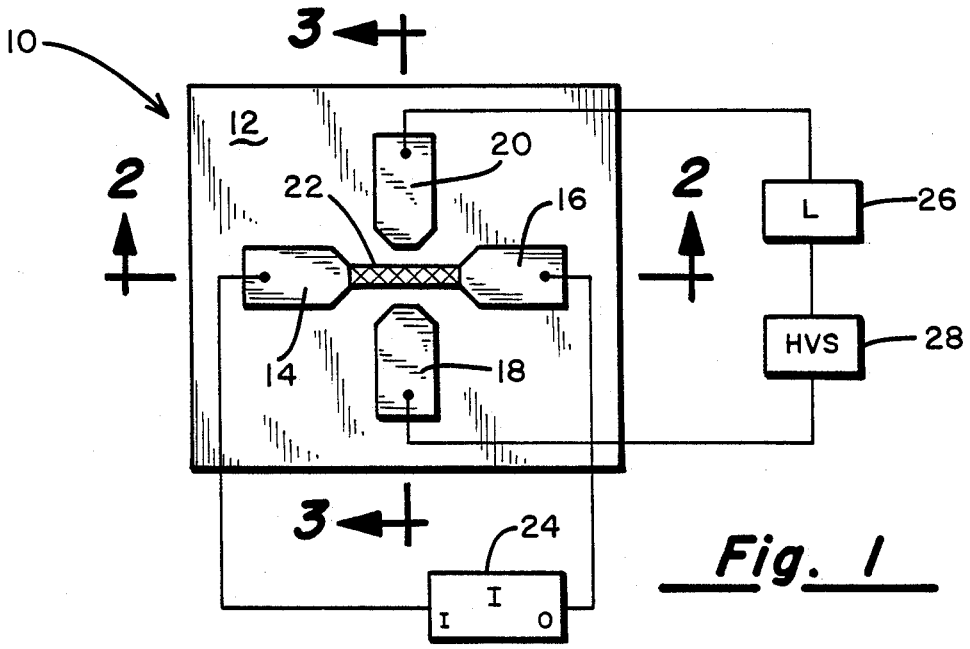
FIG. 1 is a greatly enlarged plan view of an uncased integrated silicon plasma switch chip in accordance with a first embodiment of the invention.

Referring to FIG. 1, there is shown a greatly enlarged plan view of an uncased integrated circuit chip embodying the silicon plasma switch of the present invention. The device, indicated generally by numeral 10, comprises a silicon die as a substrate 12 upon which is fabricated first and second pairs of conductive metal wire-bond pads 14–16 and 18–20. Extending between the pads 14–16 is a layer of semiconductor material 22, which is preferably polysilicon, but which may alternatively be an amorphous silicon. Wire-bond pads 14–16 are adapted to be connected to a source of trigger energy 24 while the high voltage wire-bond pads 18–20 are connected to a series combination of a load device 26 and a high voltage source 28. This voltage source may typically be a charged capacitor.

As can be seen from FIG. 1, the high voltage contacts 18–20 are spaced apart from one another across the width dimension of the semiconductor bridge element 22. The spacing between the high voltage contacts of the dielectric properties of the silicon substrate 12 are such that there is no leakage current between the contacts or between the high voltage contacts 18–20 and the semiconductor bridge element 22.

To trigger the switch, a relatively low current from energy source 24 is made to flow through the bridge element 22 and, in doing so, the energy, proportional to $I^2R$, heats the bridge element 22 to the point where the bridge is vaporized. Now, the high voltage present on pads 18–20 causes the vapor to become ionized, forming a plasma cloud in the zone between the high voltage pads or contacts 18–20. This plasma cloud presents a very low impedance discharge path between these two terminals. Thus, the high voltage source 28 is capable of delivering a very high current (1000 amps or more) to the load 26.

Figure 2:
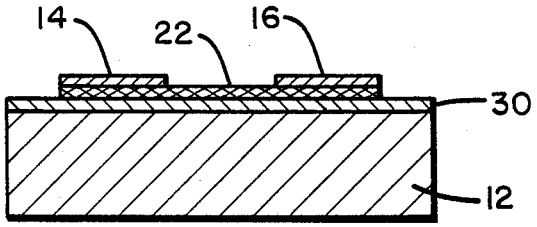
FIG. 2 is a cross-sectional view taken along the line 2—2 in FIG. 1.
Figure 3:
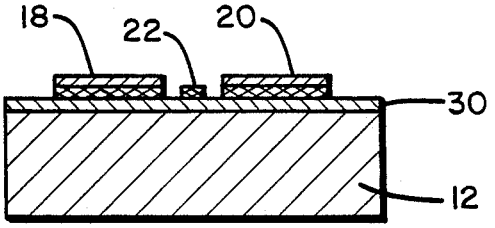
FIG. 3 is a cross-sectional view taken along the line 3—3 in FIG. 1.

Referring to the cross-sectional views of FIGS. 2 and 3, the integrated plasma switch of the present invention may be fabricated by starting with a silicon die or substrate 12. Such substrates are readily available in wafer form from several manufacturers. Typically, they may be approximately 0.020 to 0.030 inch thick and 4 to 6 inches in diameter and capable of being later partitioned into a plurality of individual integrated circuit chips. Using well-known processes and prior to such partitioning, silicon nitride may next be deposited onto a surface of the silicon wafer by a commonly known low-pressure chemical vapor deposition (LPCVD) process using dichloralsilane ($S_1Cl_2H_2$) and ammonia ($NH_3$) at a temperature of 700° C. to 800° C.

Next, silicon can be deposited, again by a LPCVD process using silane ($S_1H_4$). By maintaining deposition temperatures above 580° C., a polycrystaline film (polysilicon) will result. If the deposition temperature is maintained below 580° C. an amorphous silicon film will be deposited on the silicon nitride layer.

At this stage of manufacture, it is envisioned that a dopant can be driven into the LPCVD silicon to control the resistivity of the polysilicon material. In this fashion, it is possible to program the current required for vaporization of the silicon bridge. The doping process can be accomplished by exposing the substrate to a selected dopant gas, e.g., phopshine, while maintaining the substrate at a temperature in the range of from 900° C. to 1200° C.

To define the geometry of the bridge 22 and the conductive metal pads 14–16 and 18–20 at regularly spaced areas on the wafer substrate 12, a photosensitive material may be deposited on the surface of the polysilicon layer to allow definition of an image with a photolithography masking process. After the photosensitive material is optically exposed through the mask so as to define the desired geometry and following the developing step, the mask image is effectively transferred to the substrate.

Next, the treated substrate is subjected to selective wet chemistry. For example, a mixture of hydroflouric acid and nitric acid can be used to rapidly etch silicon, but it will not etch the LPCVD nitride layer. The photoresist protects the LPCVD silicon from the etchant, resulting in the photoresist image being etched into the LPCVD silicon. The photoresist will generally be undercut as the acid etches sideways as well as downward into the polysilicon layer.

The next step in the process is to strip away the photoresist, leaving the image of the photolithrography mask etched into the polysilicon layer.

Once the bridge shapes have been defined at multiple areas on the die, copper or aluminum may be deposited through a mask to form the wire-bond pads or contacts 14–16 and 18–20. Once the metallization step is completed, the wafer 12 can be cut into plural chips 12, each with the desired pattern thereon.

While the process described above in connection with FIGS. 2 and 3 concern the formation of the overall geometry of the polysilicon bridge, it is also contemplated that a suitable diffusion technique may be used whereby the polysilicon bridge is effectively embedded into the surface of the silicon chip 12 rather than being built up upon it.

Figure 4A:
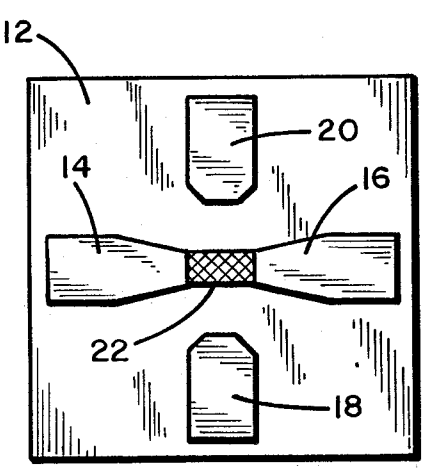
FIGS. 4*a* through 4*c* illustrate schematically the sequential switching action of the integrated silicon plasma switch of FIG. 1.
Figure 4B:
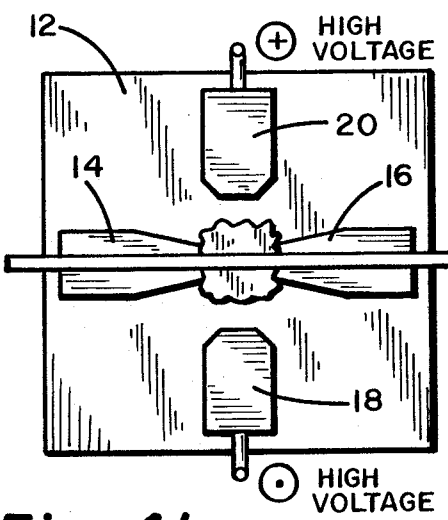
Figure 4C:
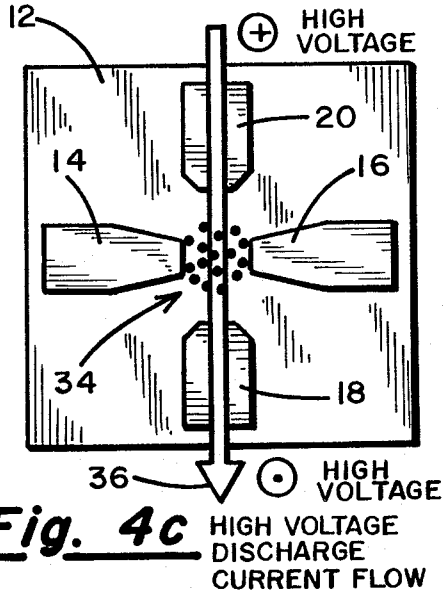

In FIG. 4, there is illustrated by means of views A, B and C, the switching sequence of the integrated plasma switch of the present invention. In view A, the bridge is intact, which is the condition prior to the application of the triggering energy across the contact pads 14–16. In view B of FIG. 4, the arrow 32 represents the silicon bridge initiation current with the bridge 22 beginning to vaporize. In view C of FIG. 4, the polysilicon vapor has matured into a plasma cloud 34 between the high voltage contacts 18–20. This permits the main discharge current represented by arrow 36 to flow between the contatts 18–20 to the load.

Figure 5:
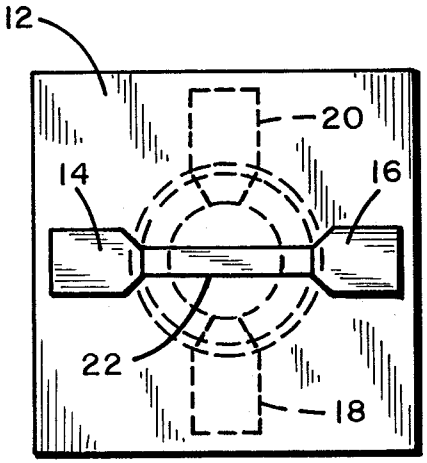
FIG. 5 is a top plan view of an alternative embodiment of an integrated silicon plasma switch.
Figure 6:
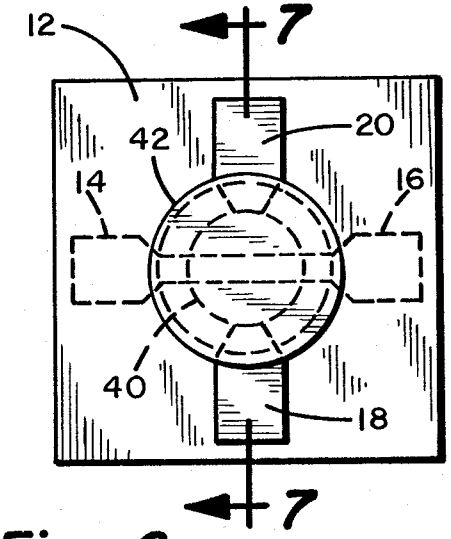
FIG. 6 is a bottom view of the embodiment of FIG. 5.
Figure 7:
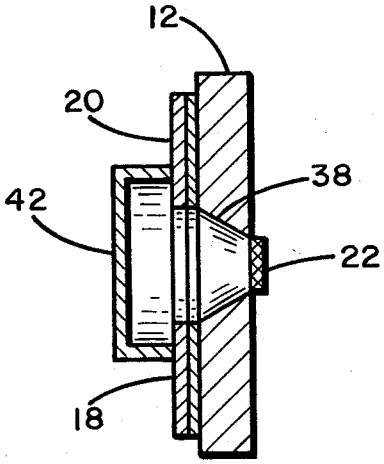
FIG. 7 is a cross-sectional view taken along the line 7—7 in FIG. 6.

To increase the high voltage isolation of the device and to reduce the triggering energy required for plasma initiation, the embodiment shown in FIGS. 1–3 may be modified in accordance with the alternative embodiment illustrated in FIGS. 5, 6 and 7. Referring to these figures, again there is provided a silicon substrate 12. On the upper surface of this chip is deposited or otherwise formed conductive metal pads 14 and 16 joined by an amorphous silicon or polysilicon bridge 22. Rather than providing the high voltage contacts 18–20 on the same side of the substrate 12 as the bridge 22 and its contacts 14–16, in the embodiment of FIGS. 5, 6 and 7, the high voltage contacts 18 and 20 are formed on the undersurface of the substrate 12, i.e. on the side of the substrate which is opposite to that on which the bridge pads 14–16 are formed. By providing this increased spacing between the high voltage contacts and the bridge 22, greater voltage isolation takes place, allowing a higher voltage to be applied to the terminals 18 and 20 without fear of voltage breakdown between them prior to triggering.

A side view of FIG. 7 reveals that the chip substrate 12 is back-etched as at 38 to form a circular opening 40 which is spanned by the polysilicon bridge 22. Suitably bonded to the underside of the chip assembly is a plasma containment cup 42. Because of the back-etching employed, the silicon bridge element 22 in this alternate embodiment is not supported over a majority of its length by the silicon substrate 12. Hence, lower triggering energy can be used to produce vaporization in that less heat is lost by parasitic thermal conduction to the silicon substrate. As the plasma cloud forms, the ceramic cup 42 precludes escape of the charged gaseous molecules, thus concentrating the plasma cloud and maintaining the low impedance plasma condition for a relatively longer period of time.

The back-etching of the substrate 12 can readily be achieved, again through the use of selective wet chemistry. For example, phosphoric acid can be used to rapidly etch the LPCVD nitride, and it will also etch silicon. Due to the fact that the acid etches both horizontally and vertically, the smaller feature size of the narrow bridge 22 will allow the LPCVD nitride to be totally etched away, resulting in an "air suspended" bridge where such a construction is desired.

Figure 8:
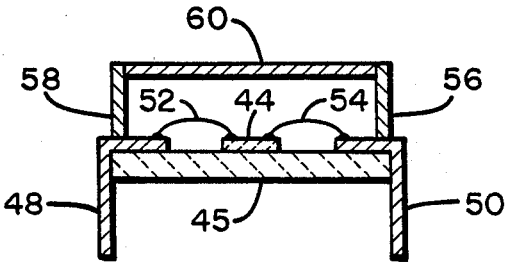
FIG. 8 is an enlarged cross-sectional view of the integrated plasma switch within a hermetically sealed package or case.

FIG. 8 is a greatly enlarged, side-sectional view showing the manner in which an integrated circuit chip shown in the embodiments of FIGS. 1 and 5 may be encased in a hermetically sealed environment with one or more gases and with a predetermined negative pressure maintained within the package. The I.C. chip itself is identified by numeral 44 and is appropriately bonded to a ceramic or plastic base 45. A plurality of conductive leads (four), as at 48 and 50, comprise the package lead frame and conductive wires 52 and 54 are ultrasonically bonded from the conductive pad areas 14–16 and 18–20 on the chip 44 to corresponding points on the package lead frame, as illustrated.

Completing the package are four side walls as at 56 and 58 made from the same material as the base 45 and which are appropriately bonded to the base. A package cap 60 is bonded to the top edge surface of the side walls in a fashion well known in the integrated circuit chip manufacturing arts. Because the number of gas molecules present, i.e., the pressure, and the type of gas molecules involved determine the excitation energy required, it is contemplated that these parameters be tailored to meet the integrated silicon plasma switch performance criteria desired. Those skilled in the art will also recognize that the geometry of the high voltage switch terminals, including their relative spacing, as well as the dimensions of the amorphous or polysilicon bridge, affect the performance of the switch, principally the energy input required for vaporization of the bridge and the formation of the plasma cloud. The resistivity of the silicon bridge can be easily controlled during manufacture by adding dopant impurities to the silicon as already indicated. A resistivity in the range of $1\times10^{-3}$ ohm centimeters to $1\times10^{2}$ ohm centimeters can easily be achieved by appropriate doping.

Figure 9:
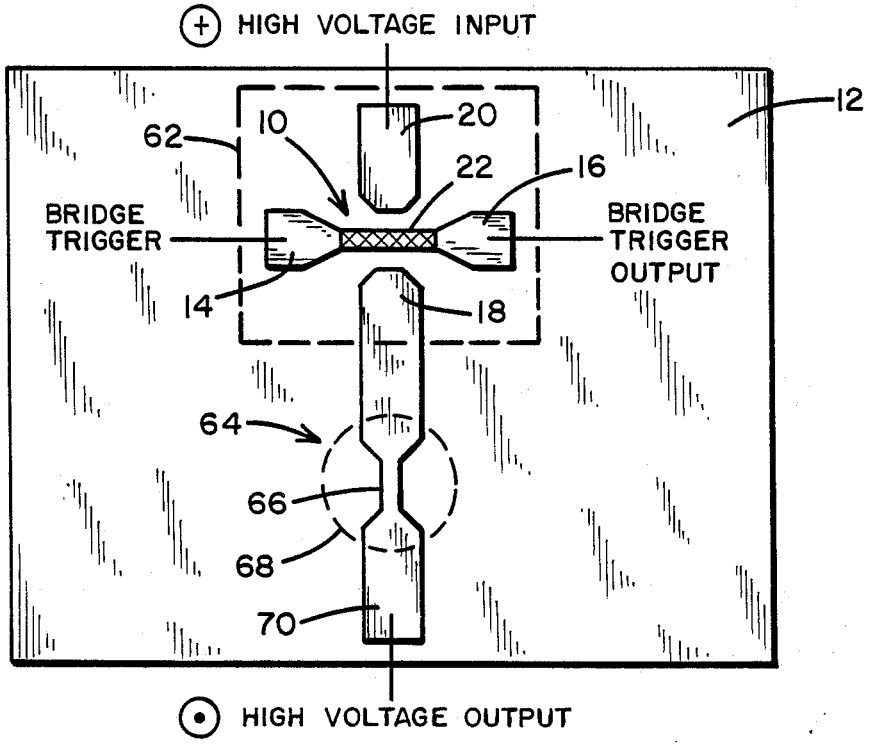
FIG. 9 is a greatly enlarged integrated silicon plasma switch combined with an integrated slapper detonator contained on the same silicon die.

FIG. 9 is included to show the manner in which devices other than the integrated silicon plasma switch can be included on the same silicon die as this switch. More particularly, in FIG. 9, the silicon chip substrate 12, in addition to carrying the integrated silicon plasma switch, shown enclosed by broken line box 62, also carries a slapper detonator, indicated generally by numeral 64.

As can be seen, the high voltage terminal 18 of the integrated silicon plasma switch 10 is coupled to a metal slapper detonator bridge 66 by an extension of the metallization comprising the high voltage terminal 18. The silicon chip substrate 12 is back-etched beneath the slapper detonator bridge 66 to create a silicon flyer 68. The remaining end of the bridge 66 joins to the high voltage output terminal 70 formed on the substrate 12.

In use, the slapper detonator bridge 66 is positioned proximate an explosive pellet such that when the bridge 22 is vaporized by the application of trigger input energy, the creation of the plasma cloud between high voltage input and output contacts 20 and 18, respectively, causes a very large current to suddenly flow through the metal slapper detonator bridge 66 to instantaneously vaporize the slapper bridge, creating a large force which shears and dislodges the silicon flyer 68, forcing it against the explosive pellet.

Figure 10:
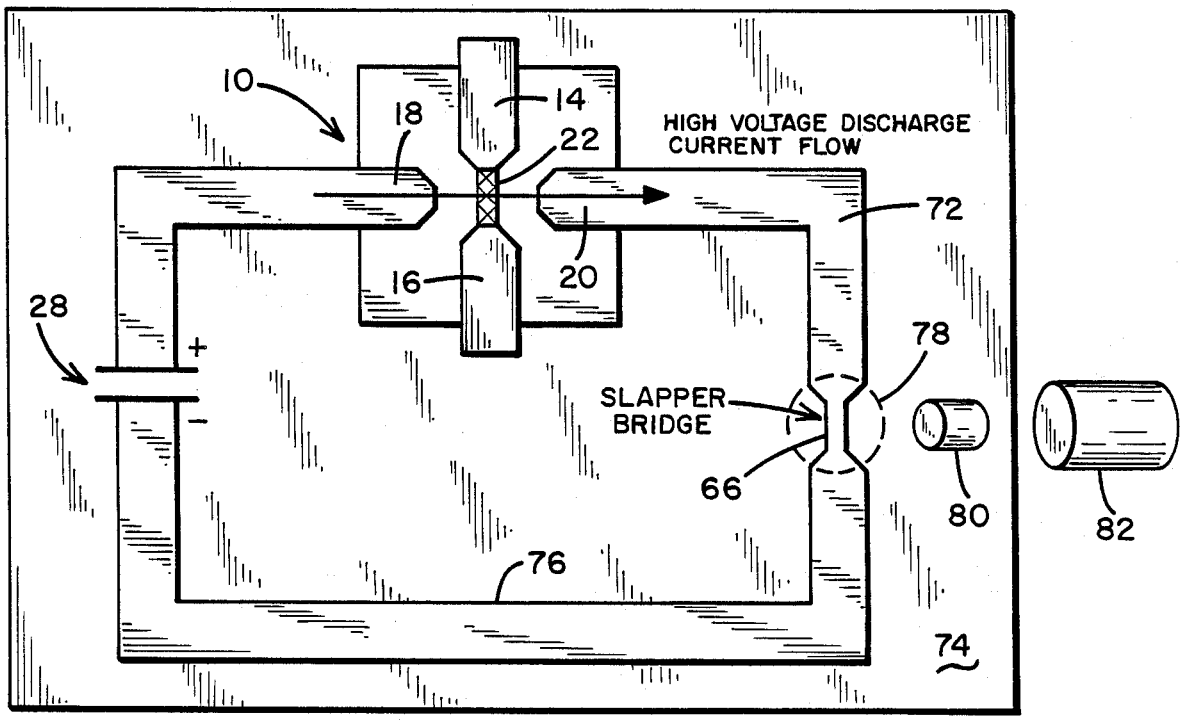
FIG. 10 illustrates the manner in which the integrated silicon plasma switch may be coupled to an external slapper detonator.

The integrated plasma switch can also be combined with off-the-chip circuitry in implementing a slapper detonator. Such an arrangement is shown in FIG. 10. The plasma switch 10 again includes an amorphous or polysilicon bridge 22 having a trigger input pad 14 and a trigger output pad 16. The plasma switch module, preferably in a case, has its high voltage input pad 18 connected to one side of a voltage source 28, here shown as a charged capacitor. The high voltage output terminal 20 is connected by a conductive path 72 to a slapper bridge 66 formed from metal on a flexible printed circuit substrate 74 which may, for example, be Kapton. The other end of the slapper bridge 66 is also joined by printed copper wiring 76 on the Kapton layer to the other terminal of the high voltage source 28. The Kapton layer 74 may be perforated or otherwise weakened, as indicated by the dashed line circle 78, and an explosive train, including, for example, a HNS pellet 80 and a booster charge 82 are appropriately aligned with the slapper bridge 66. When a trigger current is made to flow through the integrated plasma switch 22 to cause it to vaporize, the resulting plasma cloud creates a low impedance between the contact pads 18 and 20, allowing the capacitor voltage source 28 to rapidly discharge through the printed wiring on the Kapton substrate and to flow through the slapper bridge 66. This high current flowing through the bridge element 66 of significantly reduced width dimension causes that bridge element to vaporize, producing a large gas pressure for shearing and dislodging the disk-shaped piece of Kapton substrate enclosed by the perforation 78 and driving it against the pellet 80 with sufficient force to explode it. This, in turn, explodes the booster 82.

Not only may a slapper detonator bridge be formed on the same substrate as the plasma bridge, but it is also contemplated that other integrated circuit devices, such as logic devices, timing circuits and the like may be incorporated as a part of the plasma bridge triggering control circuitry.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can he accomplished without departing from the scope of the invention itself.

What is claimed is:

1. An integrated circuit device for switching high currents, comprising:

(a) a silicon chip substrate having first and second pairs of conductive contacts deposited on at least one surface of said substrate, said contacts being spaced apart along two mutually perpendicular axes;

(b) a strip of material which, when vaporized, creates a plasma cloud, disposed on said silicon chip substrate joining said first pair of contacts to one another, said strip of material extending between but out of physical contact with said second pair of contacts.

2. The integrated circuit device as in claim 1 wherein said material is amorphous silicon or polysilicon.

3. The integrated circuit device as in claim 1 wherein said first and second pairs of contacts are on the same surface of said silicon chip substrate.

4. The integrated circuit as in claim 1 wherein said first and second pairs of contacts are on opposed surfaces of said silicon chip substrate.

5. The integrated circuit as in claim 1 wherein said strip of material is defused into said silicon chip substrate.

6. The integrated circuit as in claim 1 wherein application of a predetermined potential across said first pair of terminals causes said strip of material to vaporize.

7. The integrated circuit as in claim 6 and further including means surrounding a portion of said silicon chip substrate for containing said plasma.

8. The integrated circuit as in claim 1 wherein said silicon chip substrate is of reduced thickness in a zone proximate the under surface of said strip of material.

9. The integrated circuit as in claim 1 wherein said silicon chip substrate is encased in a molded plastic housing and lead means are provided for connecting external circuitry to said first and second pairs of contacts.

10. The integrated circuit as in claim 1 wherein said second pair of contacts are connectable to a high voltage source.

11. The integrated circuit as in claim 1 wherein said silicon chip substrate also includes integrated slapper detonator means connected to one of said second pair of contacts.

12. A detonator device for use with high explosives comprising:

(a) a flexible printed circuit substrate having a pattern of metallization thereon defining first and second high voltage terminals, a relatively narrow bridge segment and relatively wide strip joining each end of said bridge segment to said high voltage terminals, said flexible printed circuit substrate having a closed perforated line defining an area directly beneath said bridge segment;

(b) an integrated plasma switch having first and second trigger terminals, a pair of high voltage contacts and a silicon bridge member joining said first and second trigger terminals; and (c) means for mounting said integrated plasma switch on said flexible substrate with said pair of high voltage contacts of said plasma switch connected in series circuit with said first and second high voltage terminals on said flexible substrate.

* * * * *